US006477934B1

(12) United States Patent
Bruhn et al.

(10) Patent No.: US 6,477,934 B1
(45) Date of Patent: Nov. 12, 2002

(54) APPARATUS FOR PROTECTING AGAINST THE EFFECT OF LAND MINE

(75) Inventors: Peter Bruhn, Neumünster (DE); Josef Schmitt, Dänischenhagen (DE); Manfred Kühl, Schwedeneck (DE); Eitel Runow, Bönebuttel (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 22 days.

(21) Appl. No.: 09/651,781

(22) Filed: Aug. 30, 2000

(30) Foreign Application Priority Data

Sep. 3, 1999 (DE) ..... 199 41 928

(51) Int. Cl.[7] ..... F41H 7/04
(52) U.S. Cl. ..... 89/36.08; 296/189; 296/190.07
(58) Field of Search ..... 89/36.07, 36.08, 89/1.13, 189, 190.07

(56) References Cited

U.S. PATENT DOCUMENTS

| | | | | |
|---|---|---|---|---|
| 2,348,130 A | | 5/1944 | Hardy | |
| 3,927,730 A | * | 12/1975 | Winslow | 296/35.2 |
| 5,172,953 A | * | 12/1992 | Chamberlain | 296/39.2 |
| 5,533,781 A | | 7/1996 | Williams | 296/204 |
| 5,915,775 A | * | 6/1999 | Martin et al. | 296/35.2 |
| 6,207,244 B1 | * | 3/2001 | Hesch | 296/189 |

FOREIGN PATENT DOCUMENTS

| | | |
|---|---|---|
| AU | 381 753 | 11/1986 |
| DE | 196 05 230 | 8/1997 |
| DE | 196 31 715 | 2/1998 |
| DE | 196 53 283 | 6/1998 |
| FR | 495476 | 10/1919 |

* cited by examiner

*Primary Examiner*—Stephen M. Johnson
(74) *Attorney, Agent, or Firm*—Venable; Norman N. Kunitz

(57) ABSTRACT

An apparatus for anti-mine protection for an armored vehicle wherein a box (5) is mounted to the underside of the vehicle floor, with the box being completely filled in the longitudinal and transverse directions with a plurality of sandbag-like damping elements (4).

12 Claims, 4 Drawing Sheets

APPARATUS FOR PROTECTING AGAINST THE EFFECT OF LAND MINE

CROSS REFERENCE TO RELATED APPLICATIONS

The present application claims the right of foreign priority of German Application No. DE 199 41 928.0 filed Sep. 3, 1999, the subject matter of which is incorporated herein by reference.

BACKGROUND OF THE INVENTION

The invention relates to an apparatus for protecting against the effect of a land mine. More specifically, the present invention relates to an apparatus for protecting against the effect of a land mine, particularly for the crew of an armored vehicle, through the mounting of protective elements on the vehicle floor.

In particular, the protection against the effect of a land mine is intended for persons in vehicles, especially in armored vehicles; with the entire vehicle being protected against the effect of the explosion of mines laid on or in the ground. Known vehicles typically have a smooth chassis underside, and the highest possible clearance between the vehicle floor and the ground, which is assured by correspondingly designed wheel or chain running gears that allow the vehicle to advance extensively unimpeded, even on rough terrain. The explosive pressure effect of the mine exploding beneath the vehicle affects the relatively large-surface vehicle floor, deforming and damaging it, and possibly causing tremendous damage inside the vehicle. In addition to the prior art, various proposals are presented for avoiding such damage.

It is known from DE 3119786 to mount sheet-type armor elements on the vehicle underside to provide protection against mines.

According to DE 19631715, the vehicle floor is equipped with a deflector that is slanted relative to the floor. The deflector can also be provided with a gas generator for protection from the inside and for counteracting the explosion.

In DE 19653283, a spatial cell is suspended separately and elastically, as a cockpit, in the vehicle housing to also eliminate external shock effects on the vehicle with respect to the persons inside the vehicle.

In further applications, deformation bodies are mounted to the vehicle floor to reduce the pressure effect of mines on the vehicle.

It is the present object of the invention to embody a generic protection system, having a simple and robust design, for ensuring sufficient protection for the crew of an armored vehicle.

SUMMARY OF THE INVENTION

The above object is accomplished according to the present invention by an apparatus for protecting against the effect of a land mine, particularly for the crew of an armored vehicle, through the mounting of protective elements on the vehicle floor, which apparatus comprise a hollow box that is mounted to and beneath the floor plate of the vehicle, with this box corresponding in length and width to no more than the length and width of the floor plate, and being filled with damping elements which are disposed adjacently, in the length and width directions and which are sandbag-like.

The attained advantages are, in particular, that a protective apparatus can be installed simply, or vehicles currently in use can be retrofitted since the apparatus is simple to mount and exchange. The protective elements, which operate according to the sandbag principle, permit repairs and rebuilding in the field in the event of damage.

Further advantageous embodiments are disclosed and claimed.

Various embodiments of the invention are schematically illustrated in the drawings and described in detail below.

DETAILED DESCRIPTION OF THE PREFERRED EMBODIMENTS

Figure 1:
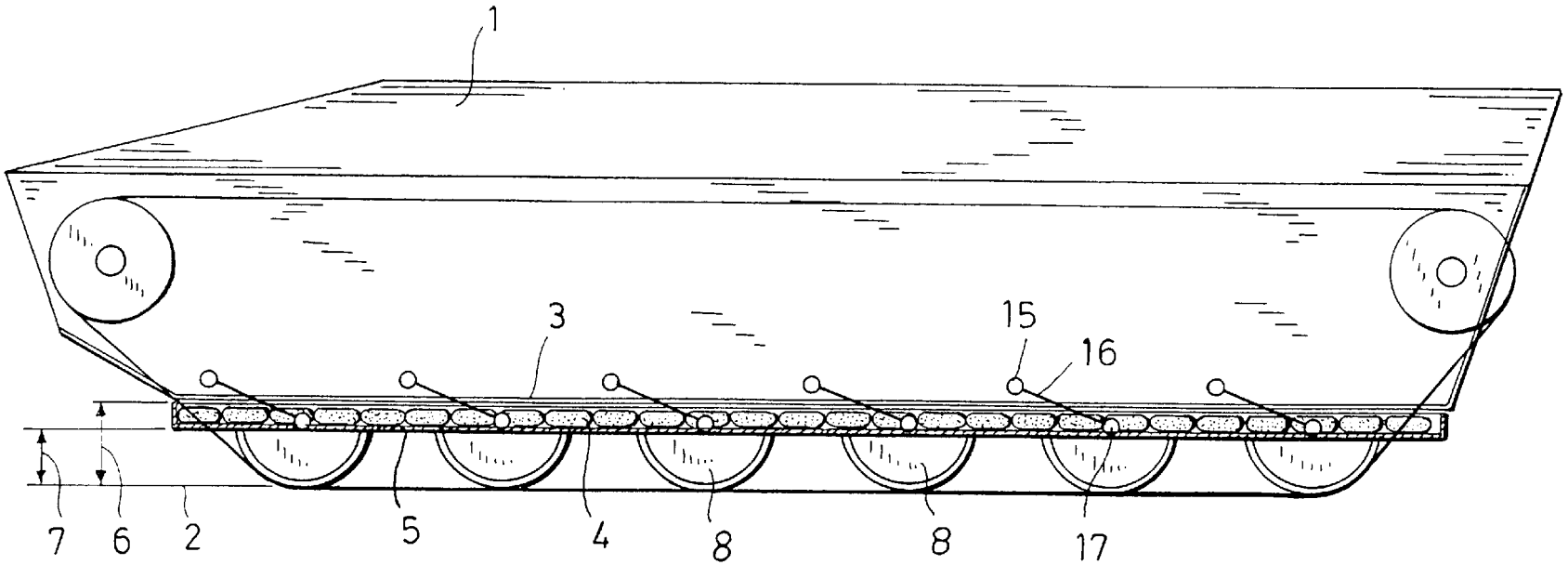
FIG. 1 is a schematic side view, partially in sections, of a vehicle provided with underside protection.
Figure 2:
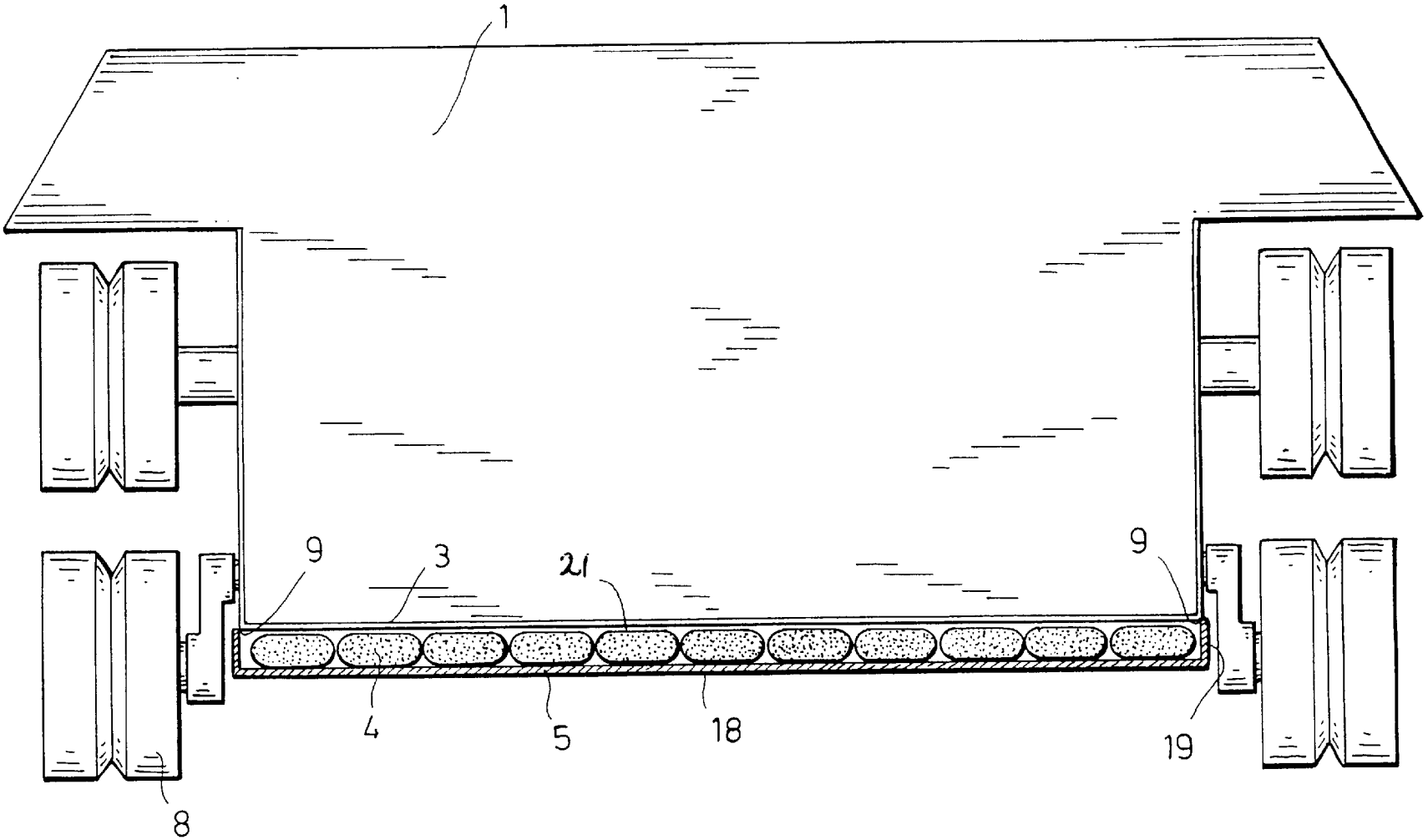
FIG. 2 is a cross section relative to FIG. 1.

As illustrated in FIGS. 1 and 2, armored vehicle 1 is provided on the underside of its floor plate 3 with a rectangular, hollow box 5, which has a small structural height relative to its planar extension, and preferably, as shown, extends over the entire width and length of the floor plate 3. However, it is to be understood that the boxes may only cover a desired partial region of the vehicle floor 3, preferably at least the crew compartment. The structural height results from the difference between the distances 6 and 7. Damping elements 4, which are comparable to small sandbags and have numerous elements, are disposed in the hollow box 5, in both the longitudinal and transverse directions of the box 5, so the interior of the box 5 is filled completely with elements. Preferably, the sandbag-like damping elements have a rectangular shape, in the horizontal plane, but other shapes, e.g., round, may also be used. The original ground clearance of the vehicle 1, which is supported on track rollers 8 on the ground 2, is indicated by the distance 6. The installation of the box 5 reduces the ground clearance to the distance 7 without otherwise modifying the vehicle.

FIGS. 1 and 2 illustrate the outline of a tracked vehicle 1. The illustrated box 5 can be mounted in the same manner on a wheeled vehicle. The box 5 is formed by a plate 18 and a circumferential, lateral edge 19, and is closed on all sides, with the upper limit being formed as a lid by the floor plate 3 of the vehicle. At the contact point 9 between the box 5 and the vehicle floor plate 3, the box 5 is permanently connected to the vehicle 1 through welding, or detachably connected by screws (not shown in detail). Additional securing points distributed over the plate 10 of the box 5 can be provided to ensure securing of the box 5 to the vehicle floor plate 3.

Figure 3:
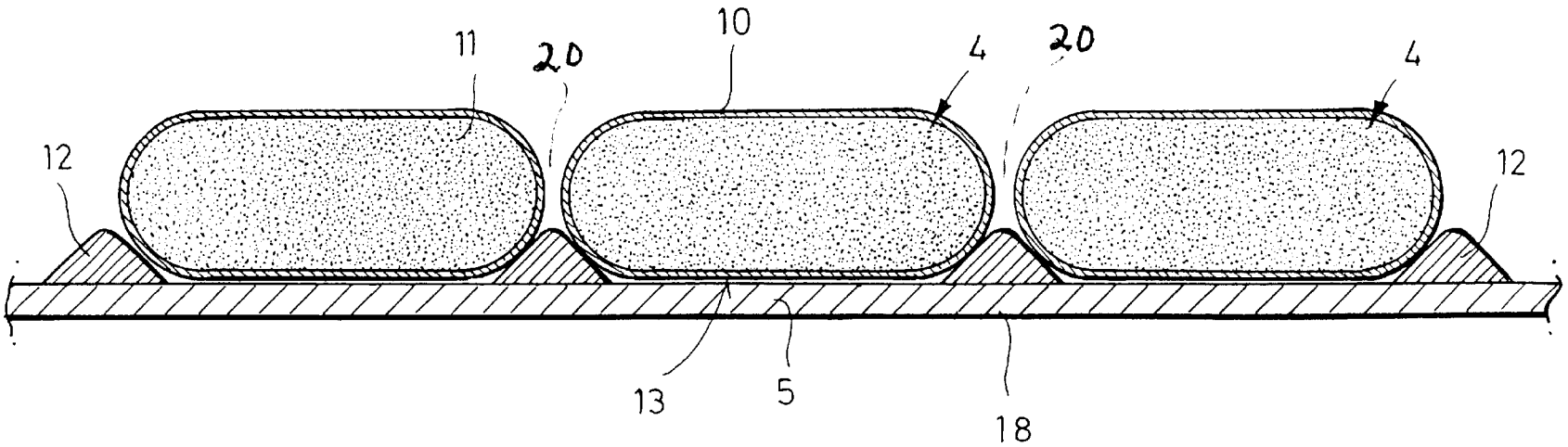
FIG. 3 is a detailed view relative to FIGS. 1 and 2.

FIG. 3 is a detailed representation of the apparatus in the longitudinal and transverse directions. The illustrated damping elements 4 are disposed adjacently in the box 5, that is, on the plate 18. Longitudinal or transverse ribs 12 are attached to the upper surface of the plate 18, for example, through welding or a press-deformation of the plate 18 for securing the elements 4. The rectangular damping elements 4 are filled with a fine-grain medium 11, such as sand, and encased in a tear-resistant covering 10. The plate 18 is given dimensional stability by beads that are pressed in over the entire plate. The ribs 12 can advantageously also be integrated with the beads. The underside 13 of the elements 4 can also be glued to plate 18.

As further shown in FIGS. 1–3, preferably an air gap 20 exists between adjacent damping elements 4 and a further air gap 21 exists between the upper surface of the damping elements 4 and the underside of the floor 3.

Figure 4:
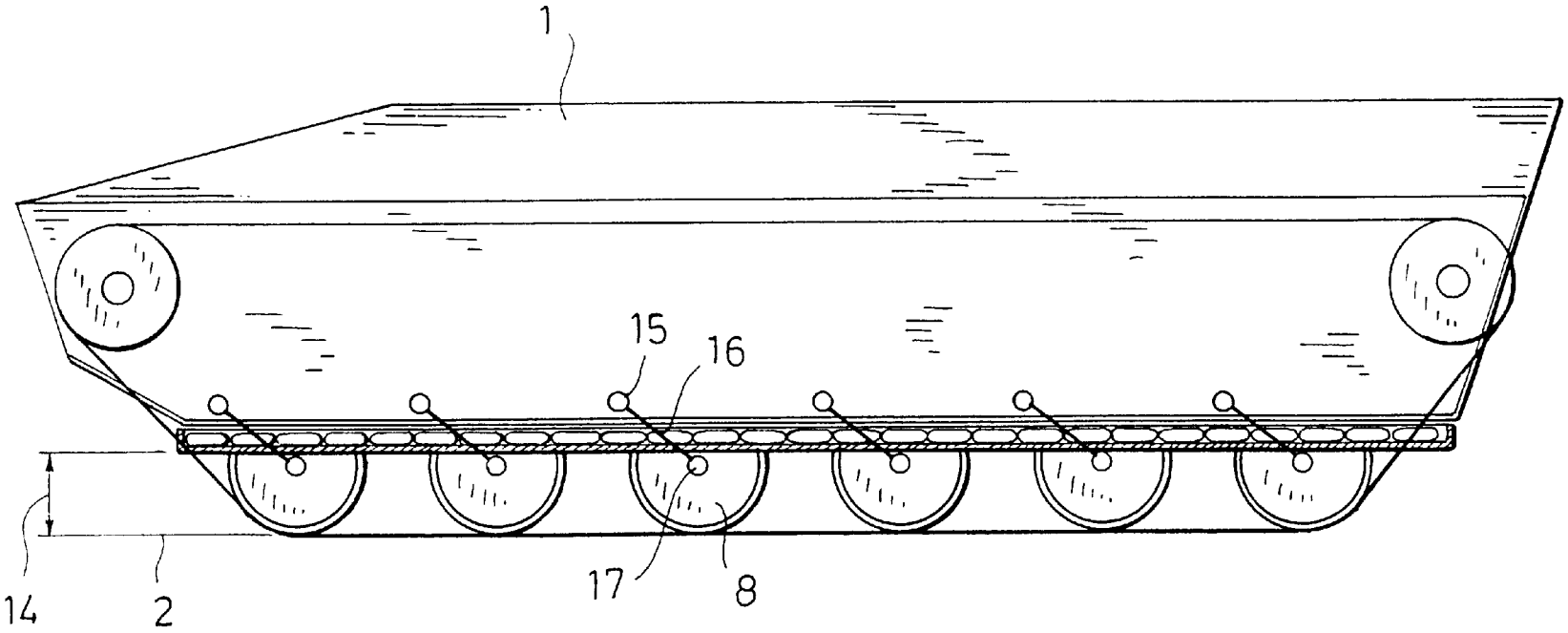
FIG. 4 is a schematic side view similar to FIG. 1, according to a modification of the invention with increased ground clearance.

As an alternative, FIG. 4 illustrates how the original ground clearance 6 from FIG. 1 can be maintained after the box 5 is mounted. The vehicle 1 attains a ground clearance with the distance 14 through the setting of the spring system 15 for each wheel, for example, the setting of the spring bars to a higher prestress, or the use of alternative spring bars, in which case the track rollers 8 are seated in bearings 17 on support arms 16. This distance 14 can match the height of the original ground clearance 6 from FIG. 1.

The invention now being fully described, it will be apparent to one of ordinary skill in the art that many changes and modifications can be made thereto without departing from the spirit or scope of the invention as set forth herein.

We claim:

1. An apparatus, in combination with a vehicle having a floor plate, for protecting the vehicle against the effect of a land mine through the mounting of damping elements on a floor of the vehicle, said apparatus comprising:

a hollow box mounted to and beneath the floor plate of the vehicle, with the box corresponding in length and width to no more than the length and width of the floor plate; and, a plurality of damping elements that are secured in position and are arranged side-by-side in longitudinal and lateral directions within the box and that fill the complete surface area of the box except for a respective air gap between adjacent damping elements and an air gap between the damping elements and the vehicle floor plate that closes off the top of the box, and with each damping element including a tear-resistant bag covering with a filling of a fine-grained medium.

2. The combination according to claim 1, wherein each damping element has a rectangular or round shape in a horizontal plane.

3. The combination according to claim 1, wherein the box comprises: a plate, a lateral edge surrounding the plate of the box, and the vehicle floor plate as an upper limit, with the box possessing a rectangular shape in the horizontal plane, corresponding to the shape and extension of the vehicle floor plate.

4. The combination according to claim 1, wherein the box only covers a partial region of the vehicle floor plate.

5. The combination according to claim 4 wherein the box only covers a crew compartment of the vehicle.

6. The combination according to claim 1, wherein the interior of the box is filled in a horizontal plane with numerous rows of the damping elements.

7. The combination according to claim 1, wherein the damping elements are secured in their position, either all the way around or on at least two sides, by ribs mounted on an upper surface of a floor plate of the box.

8. The combination according to claim 1, wherein the damping elements are glued in their position on a floor plate of the box.

9. The combination according to claim 1, wherein the box is secured at its lateral limit to the vehicle floor plate.

10. The combination according to claim 9, wherein the lateral limit of the box is secured to the vehicle floor plate by a welded connection.

11. The combination of claim 1, wherein the box has securing points distributed over a floor plate of the box and securing the box to the vehicle floor plate.

12. The combination according to claim 1 wherein the fine grained medium is sand and the damping element is a sand bag.

* * * * *